United States Patent [19]

Didiergeorge

[11] Patent Number: 4,900,174

[45] Date of Patent: Feb. 13, 1990

[54] SYSTEM FOR PROVIDING TICKETS WITH OR WITHOUT A STUB

[75] Inventor: Pierre Didiergeorge, Besancon, France

[73] Assignee: Schlumberger Industries, Montrouge, France

[21] Appl. No.: 135,094

[22] Filed: Dec. 18, 1987

[30] Foreign Application Priority Data

Dec. 19, 1986 [FR] France ..... 86 17801

[51] Int. Cl.[4] ..... B41J 11/70

[52] U.S. Cl. ..... 400/621; 400/583; 101/69; 101/288

[58] Field of Search ..... 400/621, 582, 583; 101/69, 288, 68, 61, 291, 292

[56] References Cited

U.S. PATENT DOCUMENTS

| | | | |
|---|---|---|---|
| 3,415,182 | 12/1968 | White | 400/621 |
| 3,762,317 | 10/1973 | Hamisch, Sr. | 101/68 |
| 4,240,862 | 12/1980 | Ishiyama | 101/66 |
| 4,264,396 | 4/1981 | Stewart | 101/291 |
| 4,312,597 | 1/1982 | Shimizu et al. | 400/621 |
| 4,501,224 | 2/1985 | Shibayama et al. | 101/66 |
| 4,568,950 | 2/1986 | Ross et al. | 400/621 |

FOREIGN PATENT DOCUMENTS

| | | | |
|---|---|---|---|
| 27483 | 3/1981 | Japan | 400/682 |
| 47681 | 3/1982 | Japan | 400/621 |
| 109680 | 7/1982 | Japan | 400/621 |
| 137174 | 8/1982 | Japan | 400/621 |
| 224771 | 12/1983 | Japan | 400/621 |

*Primary Examiner*—William Pieprz
*Attorney, Agent, or Firm*—Sanford J. Asman

[57] ABSTRACT

The invention provides a ticket issuing system suitable for issuing tickets with or without a stub for use in payment for parking. The ticket issuing system includes a roll (4) of paper having messages pre-printed thereon, a thermal print head (13), a motor (12) for driving the strip of paper, and means (14, 16) for cutting the paper. A control assembly (34) controls these various means to ensure that a driver is provided with a ticket and a stub or with a ticket on its own depending on whether or not the driver has pressed a button (42).

4 Claims, 4 Drawing Sheets

SYSTEM FOR PROVIDING TICKETS WITH OR WITHOUT A STUB

The present invention relates to a system for providing tickets with, or without, a stub.

BACKGROUND OF THE INVENTION

There exist numerous machines which issue tickets having specific items mentioned on each ticket, i.e. items which vary from one ticket to another. When these machines are automatic, it is necessary for them to be capable of causing said items (which they contain in memory or which are transmitted thereto) to be printed on the ticket and then to cut the printed ticket from the remainder of a strip of paper or the like on which tickets are printed.

One particular case of such machines is constituted by dispensers for issuing tickets that buy a certain amount of parking time. With such machines, a driver who has parked a vehicle inserts into the machine an amount of money which corresponds to the desired parking time. In exchange for this sum of money, the machine issues the driver with a ticket which mentions at least the current date and the time limit at which paid-up parking expires, given the amount of money paid. The driver then places this ticket behind the windshield of the vehicle so that parking inspectors can verify whether a parked vehicle is authorized. Accompanying FIG. 1 shows one such ticket. In order to remind drivers that they must display the ticket, the ticket should include a legible message such as: "PLACE THIS TICKET BEHIND YOUR WINDSHIELD SO IT CAN BE READ FROM OUTSIDE" and this message is given the reference PM in the figure. In addition, each ticket must display, in the clear, items explaining the special information printed on the ticket: "PARKING TIME EXPIRES"; "DAY"; "DATE"; etc. and these items are reference M1, M2, M3, and M4, on accompanying FIG. 1. The parking ticket vending machine has a strip of paper stored as a roll together with print means and a system for cutting printed tickets from the remainder of the strip.

In order to keep down the amount of information that needs printing on the strip when issuing each ticket, it is common practice to use a strip on which the above-mentioned items are pre-printed in appropriate zones on the strip, in which case the printing means need only be used for printing items which are specific to each ticket.

Organizations that provide paid-for parking controlled by such ticket-issuing means tend to supply users with tickets having stubs or counterfoils. Accompanying FIG. 2 shows an example of a ticket with its stub. The ticket comprises a portion constituting the "ticket" per se and referenced E which is identical to the ticket in FIG. 1, together with a "stub" portion which is referenced F in FIG. 2 and which reproduces at least some of the specific items printed on the ticket portion per se and which also includes the message "KEEP THIS STUB" referenced DM in FIG. 2. The "stub" portion is connected to the "ticket" portion by a line of perforations. The driver places the ticket behind the windshield while retaining the "stub". The driver can therefore inspect the stub at any moment in order to be reminded of the time at which authorized parking expires.

Depending on the services which parking management organizations desire to offer their customers, ticket-dispensing machines may be loaded either with pre-printed rolls having no stubs or else with pre-printed rolls having both tickets and stubs, and the machines are adjusted accordingly.

This situation suffers from drawbacks. The pre-printed strip of paper is generally of the thermal type. The paper is therefore expensive. However, issuing tickets with accompanying stubs means that the length of the roll of paper required for a given number of tickets is nearly doubled compared with the length that would be required for issuing tickets without stubs. In other words, a roll of paper of given size lasts only about half as long, thereby doubling the frequency at which the machine needs maintenance.

It turns out, in practice, that many drivers do not use ticket stubs. Consequently, supplying stubs to these drivers does not improve the service offered to them, but does increase the operating costs to the operating organization in a manner which is not negligible.

In order to remedy this drawback, an aim of the invention is to provide a ticket-issuing system which issues users either with a ticket including a stub or else with a ticket having no stub, at the request of each user.

SUMMARY OF THE INVENTION

According to the invention, this aim is achieved by providing a system for issuing tickets with or without a stub, wherein the tickets per se are required to include a first message and not to include a second message and wherein the stubs are required to include said second message and not to include said first message, the system including a strip of paper and a dispensing device, said device including means for advancing said strip of paper, means for printing on said strip of paper, and means for cutting said strip, and the system including the improvement whereby said dispensing device further includes means for selecting between having a ticket issued without a stub and having a ticket issued with a stub, and control means, which control means are:

responsive to the selection of a ticket without a stub to cause specific items to be printed on a portion of said strip of paper, and to cause said strip to be cut to issue a piece of paper whose length is equal to one such portion and includes said first message; and responsive to the selection of a ticket with a stub to print the specific items on two consecutive portions and also to print said second message on the second of said two consecutive portions, and to cause said strip of paper to be cut a first time to issue a piece of paper whose length is not less than the length of one portion and which includes a first message, and to cut the strip a second time so as to issue a second piece of paper whose length is not greater than one portion and which includes the second message, whereby said first piece of paper constitutes the ticket per se and said second piece of paper constitutes the stub corresponding to said ticket.

In a first implementation of the invention, the control means are responsive to a stub-free ticket being selected to cause said first message to be printed on a portion of said strip of paper; and to a ticket with stub being selected to cause said first message to be printed on said first portion and said second message to be printed on said second portion of two consecutive portions, and also to cause said strip to be cut a first time so that the first piece of paper cut from the strip is equal in length to one portion and includes the first message, and a second time so that the second piece of paper cut from the strip is equal in length to one portion and includes said second message, such that the first piece of paper constitutes a ticket per se, and the second piece of paper constitutes the stub corresponding to said ticket.

In a second implementation of the invention, said strip of paper includes said first message on each portion of paper and the control are responsive to a request for a ticket with a stub, to cause the second message to be printed on the second of two consecutive portions and also to cause said first piece of paper to be cut from said strip in such a manner that the first piece of paper includes said first message twice over while said second piece of paper does not include said first message at all, thereby ensuring that said first piece of paper constitutes a ticket per se and said second piece of paper constitutes a stub corresponding to said ticket.

In a third implementation of the invention, said strip of paper includes said first message pre-printed on each portion, and the control means are responsive to the selection of a ticket with a stub, to cause the second message to be printed on the second of two consecutive portions and also to cause said first message to be obliterated thereon.

By virtue of these special dispositions, it will be understood that a user receives either a ticket on its own or else a ticket accompanied by a separate stub having the appropriate items printed thereon, depending on the user's initial selection. However, the machine only requires one strip of paper for issuing both types of ticket.

BRIEF DESCRIPTION OF THE DRAWINGS

Implementations of the invention are described by way of example with reference to the accompanying drawings, in which.

MORE DETAILED DESCRIPTION

Figure 1:
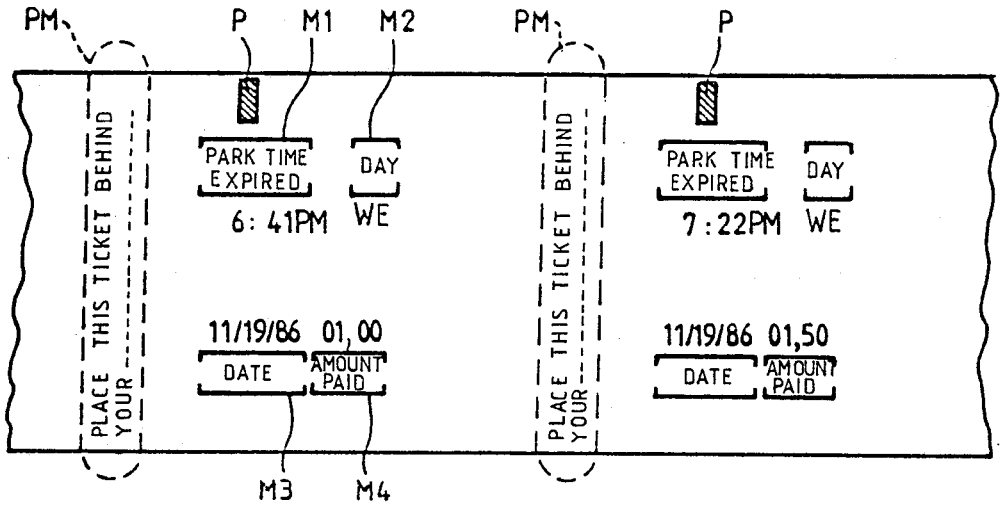
FIG. 1, as described above, shows a ticket of conventional type without a stub.
Figure 2:
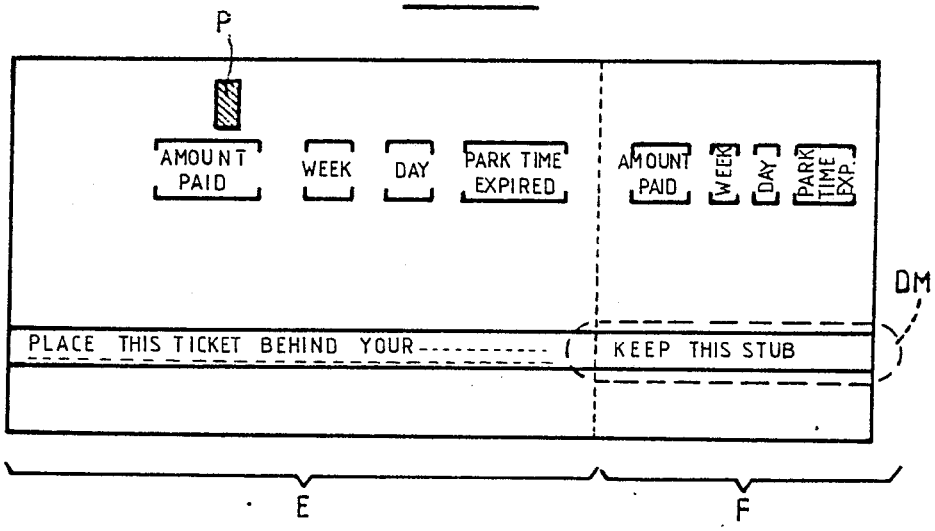
FIG. 2, as described above, shows a ticket of conventional type together with a stub.

An embodiment of a system for issuing tickets is described with reference initially to FIG. 3. The system comprises a support 2 for a roll 4 of paper which is used for making tickets. The strip of paper 6 is driven, for example, by a drive wheel 8 pressing against a wheel 10. The wheel 8 is rotated by a motor 12 so as to advance the strip of paper 6 at a known speed. Beyond the wheels 8 and 10, the strip of paper is guided to pass a print head 13 which, in the present invention, is a thermal print head. Thermal print heads are well known and it is therefore unnecessary to describe one in greater detail. At the outlet from the print head 13, there is a paper cutter comprising a fixed knife blade 14 and a moving knife blade 16 whose motion is controlled by a motor 18. After being cut from the remainder of the strip, the ticket 20 is dropped into a chute 22 from which it can be recovered.

In the presently described example, the strip of paper 6 is of the pre-printed heat-sensitive type. As shown better in FIG. 1, the heat-sensitive strip of paper 6 includes a reference point P in each portion of the strip which corresponds to a ticket. The reference point P is located close to the edge of the strip of paper 6 and serves to index the positioning of the pre-printed messages relative to the messages which are printed on the ticket by means of the print head 13. To do this, the print system further includes, as shown in FIG. 3, an optical sensor 24 disposed upstream from the print head 13. The sensor 24 is disposed to detect the reference points P and to generate an indexing signal each time it detects such a point P. In addition, the various items to be printed on a ticket are printed in the form of columns of successive dots extending along a direction which is perpendicular to the direction of displacement of the strip of paper. In order to ensure proper printing, it is necessary to synchronize the control of dots printed by the thermal head along a print column with the displacement of the strip of paper 6. This synchronization is obtained by means of a wheel 26 which is provided around its periphery with regularly distributed notches 28. The wheel 26 is rotated by the drive wheel 8 and its speed of rotation is proportional to the speed at which the strip of paper moves. A second optical sensor 30 delivers a synchronizing signal each time a notch passes said sensor.

The motors 12 and 18 and the thermal printer 13 are controlled by a microprocessor 32. The microprocessor 32 controls the sequencing of the stages described below on the basis of programs which are stored in its memory and on the basis of signals delivered by the detectors 24 and 30.

Figure 3:
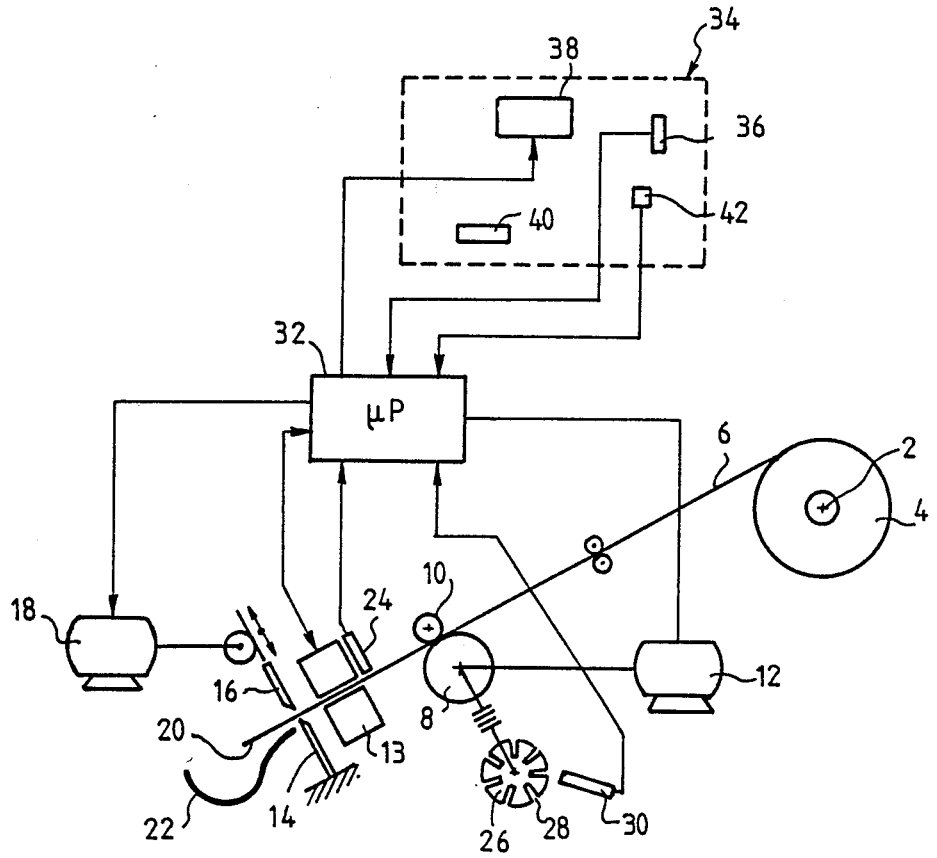
FIG. 3 is an overall view of a system for supplying tickets with or without stubs.

FIG. 3 also shows, in simplified manner, the front face 34 of the ticket dispensing device. This figure shows a coin insertion slot 36 by which a parking fee is paid. The slot 36 is associated with a coin selector mechanism (not shown) which sends information to the microprocessor indicative of the amount of money inserted into the machine. FIG. 3 also shows a display device 38 under the control of the microprocessor 32 for displaying, in particular, the time at which paid-up parking expires as a function of the amount of money inserted. Finally, the front face 34 includes an opening 40 which corresponds to the ticket-dispensing chute 22 and a pushbutton 42 which is operated by a driver if a ticket stub is required. When the user presses the button 42, it applies a signal S to the microprocessor 32. It would also be possible to provide two buttons, one corresponding to selecting a ticket with a stub and the other corresponding to selecting a ticket without a stub.

Figure 4:
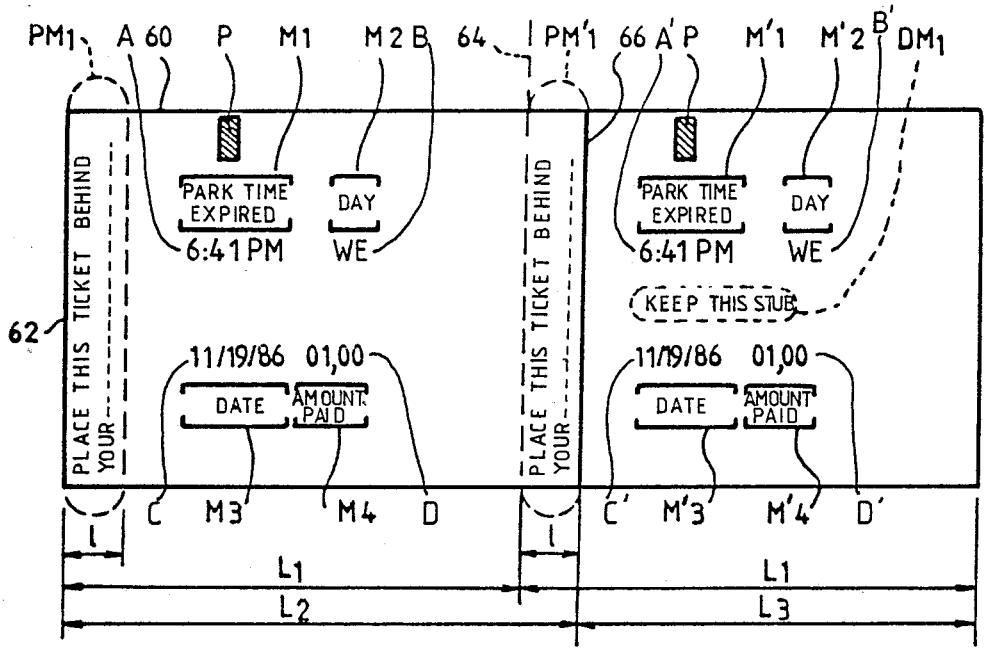
FIG. 4 shows a first type of pre-printed paper strip useable with the FIG. 3 system.

Reference is made initially to FIG. 4, for describing a first embodiment of the invention.

FIG. 4 shows a portion of a strip of paper 60 corresponding to a ticket having a stub. This portion of strip 60 has two pre-printed messages: "Place this ticket . . ." referenced PM1 and PM'1 which are separated from each other by a gap L1 having the same length as a ticket without a stub. The strip of paper 60 also has other pre-printed messages M1, M2, M3, and M4 on the first length L1, and M'1, M'2, M'3, and M'4 on the second length L1 of the paper. These messages serve to explain the information which is subsequently printed on the paper by the thermal print head 13. The messages M1, M2, M3, and M4, are respectively identical to the messages M'1, M'2, M'3, and M'4 and they occupy the same positions relative to the leading edge 62 of the portion of strip 60 and the dashed line 64 situated at distance L1 from the leading edge 62. Finally, the portion of strip 60 has an overall length 2L1. Looking at the entire strip of paper 6, it comprises a succession of pre-printed marks PM1, M1, M2, M3, and M4 which repeat identically at a pitch equal to L1.

Returning to FIG. 3, a first embodiment of the invention is now described. The user inserts an amount of money into the slot 36 corresponding to a desired length of parking time. The corresponding time limit is displayed by the display device 38. After checking the display, the user presses on the button 42, or does not press on said button, depending on whether or not the user wants a ticket with a stub. If the button 42 is not pressed, then the ticket is printed without a stub as follows. The motor 12 is set into operation, thereby driving the strip of paper 6. When the reference P is detected by the sensor 24, the print head 13 is controlled to print specific items A, B, C, and D on the ticket. In FIG. 4, these items correspond to the time at which authorized parking expires, the day of the week, the date, and the amount paid. The various points on the thermal print head are activated synchronously on the basis of pulses delivered by the sensor 30 which co-operates with the notched wheel 26. After printing the specific items, the strip of paper is driven until the perforated line 64 arrives in the cutting plane of the cutter tool 14, 16. The ticket is then cut from the remainder of the strip. The user retrieves the ticket from the slot 40. The strip 6 is ready for issuing a new ticket either with, or without a stub.

We now consider the case of a driver who presses on button 42 in order to obtain a ticket with a stub. Operations take place as described above until specific items A, B, C, and D have all been printed. Thereafter, the microprocessor 32 actuates the motor 12 until solid line 66 arrives in the cutting plane of the tool 16, 14. The line 66 is situated at a distance L2 from the leading edge 62 of the strip of paper. The following relationship applies: $L2 = L1 + 1$, where 1 is the length of the strip of paper occupied by the first message PM1, PM'1, etc. . . .

After being cut at this point, the driver retrieves a ticket per se from the slot 40 which is distinguished solely by the fact that the message PM1 "Place this ticket . . ." occurs twice thereon. The microprocessor then controls the motor 12 to move the strip again. When the sensor 24 detects the reference P a second time, the print head 13 is again controlled to print a second message DM1 which corresponds to the "stub" message, together with specific items A', B', C', and D' which are identical in meaning to the specific items A, B, C, and D, but are advantageously printed using a different type face.

When the strip of paper has moved forward by a length L3 where $L3 = L1 - 1$, the motor 12 is stopped and the cutting tool 14, 16 is controlled to separate the stub printed in this way from the remainder of the strip. The strip of paper 6 is once again ready for having a new ticket printed thereon either with or without a stub.

The user thus obtains a ticket per se which includes the first message PM requesting the user to put the ticket behind the windshield of the parked vehicle, together with a stub which includes the second message DM1.

The pre-printed strip shown in FIG. 4 can be used to implement a variant of this first embodiment of the invention. After printing the items which are specific to the parking ticket, the motor 12 is stopped when the strip has advanced by an amount L1 and the strip of paper is cut under the control of the microprocessor 32. This provides a ticket which is entirely standard. Thereafter, the motor 12 is controlled to advance the strip by a length 1 corresponding to the length of the first message PM'1. The cutting tool 14, 16 is again actuated and the system is back in the situation described above for printing the stub.

Figure 5:
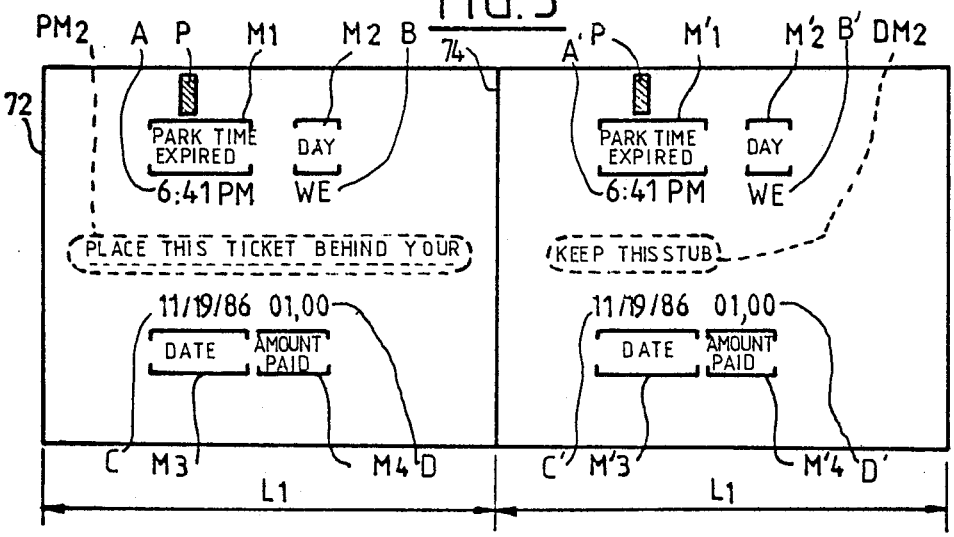
FIG. 5 shows a second type of pre-printed paper strip useable with the FIG. 3 system.

Reference is now made to FIG. 5 which describes a second embodiment of the ticket-issuing system. This figure shows a portion 70 of the strip of paper used. The strip 70 has sets of pre-printed messages M1, M2, M3, and M4; M'1, M'2, M'3, and M'4 which are identical to those shown in FIG. 4 and which are repeated at the same interval L1 from the leading edge 72 of the strip. Unlike the situation shown in FIG. 4, the first messages PM1, PM'1, are not pre-printed.

Returning to FIG. 3, the operation of this second embodiment of the invention is described. If the user does not press on the button 42, i.e. if the user does not want a stub, the following operations take place: the motor 12 is set into motion to drive the strip of paper 6 which now has the preprinted messages as shown in FIG. 5. When the sensor 24 detects the reference mark P, the print head 13 is actuated to print the special items A, B, C, and D as already described, and also to print a first message PM2 which is the same as the first message PM1 shown in FIG. 4, except that it is printed differently (i.e. by the thermal printed rather than by the pre-printing applied to the strip of paper). When the strip of paper has advanced by a length L1, the motor 12 is stopped and the cutting tool 14, 16 is actuated to cut off the ticket. The user then retrieves a stub-free ticket from the slot 40, which ticket is constituted by the length of strip which is delimited by lines 72 and 74 in FIG. 5. The motor 12 is then put back into operation. When the sensor 24 detects that the reference mark P has again moved past it, the print head 13 is again ready to print a new ticket.

If the user presses the button 42, the operations take place as described above, except that after printing the ticket per se, the print head 13 is again controlled by the microprocessor 32 to print a second message DM2 which is the same as the second pre-printed message DM1 described with reference to FIG. 4, together with the specific items A', B', C', and D'. When the strip has advanced by a length equal to L1, the motor 12 is stopped and the cutting tool 14, 16 cuts off the printed stub from the remainder of the strip.

Figure 6:
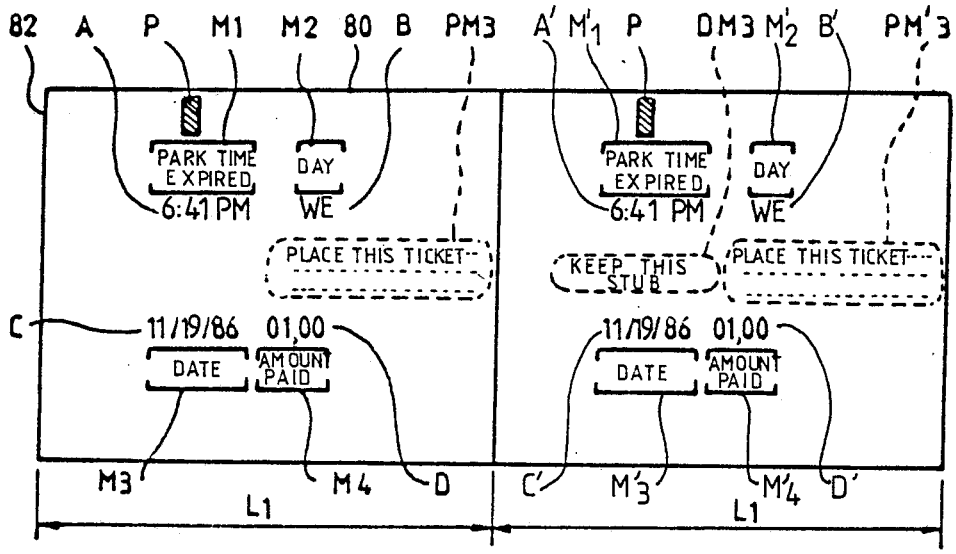
FIG. 6 shows a third type of pre-printed paper strip useable with the FIG. 3 system.

Reference is now made to FIG. 6 for describing a third embodiment of the invention. In this third embodiment, the strip of paper 80 has the following pre-printed messages and a pitch equal to L1: above-described items M1 to M4; and a first item PM3 which is the same as the first messages PM1 and PM2 but which is disposed entirely in the middle of the strip of paper 80 so as to be entirely accessible to the print head 13.

With this type of strip 80, when a user has selected a ticket without a stub, the motor 12 is controlled to drive the strip of paper 6 and the print head is controlled by microprocessor 32 to print the specific items A to D. When the strip has advanced by a length L1, the motor 12 is stopped and the strip of paper is cut in order to remove the ticket from the remainder of the strip. If the user has actuated the button 42 in order to obtain a ticket with a stub, then the ticket dispensing device begins by performing the same operations as those for dispensing a ticket on its own. However, it then continues by printing a stub which it does by controlling the motor 12 and the print head 13 to print the second message DM3 relating to the "STUB", together with the specific items A' to D'.

In addition, the print head cancels the first message PM3 by printing thereover. When the strip of paper has advanced by a length L1, the motor 12 is stopped and the cutting tool 14, 16 cuts off the stub as printed in this way from the remainder of the strip.

In should be observed, that in the variant of the first embodiment and in the second and third embodiments of the invention, when a ticket having a stub is selected, the machine begins by dispensing a ticket which is identical to the ticket it would have dispensed has a stub-free ticket been selected. In these cases, the operation of the selector member constituted by the button 42 may be modified. Regardless of the type of ticket desired by the user, the machine begins by delivering a stub-free ticket corresponding to the type of paper strip loaded in the machine. If the user desires a stub, a limited period of time is allowed during which the user may press the button 42 a second time in order to cause a stub to be issued in one of the ways described above. Naturally, if more coins have been inserted into the machine during this period of time, the next depression of the button 42 causes the microprocessor to print a new ticket rather than to print a stub for the previous ticket. Similar considerations apply if the button is pressed after the period of time has elapsed.

It will be understood that the invention enables a driver to obtain a ticket with a stub on request or a ticket without a stub, even though the ticket-dispensing device has only one roll of pre-printed paper loaded therein. Further, it is important to underline the fact that only the ticket has the message "Place this ticket behind . . ." and the ticket does not include the "stub" message, whereas the stub has the "stub" message only and does not have the other message. Thus, a driver is prevented from attempting to commit the fraud which would consist in failing to place the ticket behind the windshield or in placing only the stub behind the windshield on the grounds that the messages on the pieces of paper are ambiguous. In addition, the messages placed on the ticket and the stub are sufficiently different to ensure that an inspector for checking that parking has been properly paid for can easily see that a ticket and not a stub has indeed been placed behind the windshield.

I claim:

1. A system for issuing tickets with or without a stub, wherein said tickets are required to include a first message and not to include a second message and wherein said stub is required to include said second message and not to include said first message, the system comprising a strip of paper consisting of portions having a predetermined length L1, including said first message preprinted on each of said portions and a dispensing device, said dispensing device comprising:

means for advancing said strip of paper;

means printing on said strip of paper;

means for cutting said strip;

selector means for selecting between having a ticket issued without a stub and having a ticket issued with a stub; and control means including a microprocessor and responsive to said selector means, to:

in response to the selection of a ticket without a stub, cause specific items to be printed on a portion of said strip of paper, and cause said strip to be cut to issue a piece of paper that includes said first message preprinted;

in response to the selection of a ticket with a stub, print said specific items on two consecutive portions and print said second message on the second of said two consecutive portions, and cause said strip of paper to be cut a first time to issue a first piece of paper which includes said first message preprinted thereon and cut the strip a second time so as to issue a second piece of paper which includes said second message, whereby said first piece of paper constitutes said ticket and said second piece of paper constitutes said stub corresponding to said ticket and wherein said first piece of paper includes said first message preprinted twice over while said second piece of paper does not include said first message preprinted at all.

2. A system for issuing tickets according to claim 1 wherein each portion of said strip includes a mark and said dispensing device comprises means for detecting said marks.

3. A system for issuing tickets with or without a stub, wherein said tickets are required to include a first message and not to include a second message and wherein said stub is required to include said second message and not to include said first message, the system comprising a strip of paper consisting of portions having a predetermined length L1, including said first message preprinted on each of said portions and a dispensing device, said dispensing device comprising:

means for advancing said strip of paper;

means printing on said strip of paper;

means for cutting said strip;

selector means for selecting between having a ticket issued without a stub and having a ticket issued with a stub; and control means including a microprocessor and responsive to said selector means, to:

in response to the selection of a ticket without a stub, cause specific items to be printed on a portion of said strip of paper, and cause said strip to be cut to issue a piece of paper that includes said first message preprinted;

in response to the selection of a ticket with a stub, print said specific items on two consecutive portions and print said second message on the second of said two consecutive portions, and cause said strip of paper to be cut a first time to issue a first piece of paper which includes a said first message preprinted thereon and cut the strip a second time so as to issue a second piece of paper which includes said second message, whereby said first piece of paper constitutes said ticket and said second piece of paper constitutes said stub corresponding to said ticket and wherein said first message preprinted on the second of said two consecutive portions is caused to be obliterated thereon.

4. A system for issuing tickets according to claim 3 wherein each portion of said strip includes a mark and said dispensing device comprises means for detecting said marks.

* * * * *